US007054581B2

(12) United States Patent
Yoshikawa et al.

(10) Patent No.: US 7,054,581 B2
(45) Date of Patent: May 30, 2006

(54) DEVELOPER SUPPLY CONTAINER

(75) Inventors: Junko Yoshikawa, Toride (JP); Tetsuo Isomura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 10/796,073

(22) Filed: Mar. 10, 2004

(65) Prior Publication Data

US 2004/0234297 A1 Nov. 25, 2004

(30) Foreign Application Priority Data

Mar. 11, 2003 (JP) ..... 2003-064561

(51) Int. Cl.
*G03G 15/00* (2006.01)

(52) U.S. Cl. ..... 399/227; 399/258; 399/260

(58) Field of Classification Search ..... 399/227, 399/258, 260

See application file for complete search history.

(56) References Cited

U.S. PATENT DOCUMENTS

| | | | | |
|---|---|---|---|---|
| 5,565,973 | A | 10/1996 | Fujishiro et al. | |
| 6,418,290 | B1 | 7/2002 | Isomura et al. | |
| 6,704,533 | B1 | 3/2004 | Isomura et al. | |
| 6,763,215 | B1 * | 7/2004 | Jones | 399/260 |
| 2003/0223782 | A1 | 12/2003 | Ban et al. | |
| 2004/0033087 | A1 | 2/2004 | Yoshikawa et al. | |
| 2004/0052553 | A1 | 3/2004 | Isomura et al. | |
| 2004/0247331 | A1 * | 12/2004 | Minagawa et al. | 399/27 |
| 2005/0013635 | A1 * | 1/2005 | Yamada | 399/258 |
| 2005/0053399 | A1 * | 3/2005 | Okino et al. | 399/260 |

FOREIGN PATENT DOCUMENTS

| | | |
|---|---|---|
| JP | 6-102758 | 4/1994 |
| JP | 8-44183 | 2/1996 |
| JP | 8-328346 | 12/1996 |

* cited by examiner

*Primary Examiner*—Christopher W. Fulton
*Assistant Examiner*—Tania Courson
(74) *Attorney, Agent, or Firm*—Fitzpatrick, Cella, Harper & Scinto

(57) ABSTRACT

A developer supply container substantially non-rotatably mountable, with a developing device for developing an electrostatic image with a developer, to a rotatable member provided in an image forming apparatus, the developer supply container being adapted to supply a developer into the developing device therefrom with rotation of the rotatable member, the developer supply container includes a container body for containing the developer; a discharging opening, formed in a peripheral surface of the container body, for permitting downward discharge of the developer; a feeding portion, provided on an inside surface of the container body, for feeding the developer in a feeding direction toward the discharge opening with rotation of the rotatable member; and a developer movement constraining portion, provided adjacent a position opposed to a position of the discharge opening on the inside surface of the container body, independently of said feeding portion, for constraining the developer which is reversed into the container body through the discharge opening when the discharge opening faces upward with rotation of the rotatable member, from moving in a direction opposite to the feeding direction.

6 Claims, 7 Drawing Sheets

DEVELOPER SUPPLY CONTAINER

FIELD OF THE INVENTION AND RELATED ART

The present invention relates to a developer supply container removably mountable in an electrophotographic or electrostatic image forming apparatus in order to supply the image forming apparatus with developer.

In particular, the present invention relates to a developer supply container which is to be held in the rotary of an image forming apparatus to be connected to a developing apparatus held also in the rotary, and which is structured to use the rotation of the rotary to supply the developing apparatus with the developer in the container.

Developer in the form of particulates has long been used as the developer for an image forming apparatus such as an electrophotographic copying machine, a printer, etc. As the amount of the developer in the main assembly of an image forming apparatus reduces to a critical level due to consumption, a developer supply container is used to supply the image forming apparatus with developer.

An image forming apparatus such as a full-color copying machine, a full-color printer, or the like, requires a plurality of developers different in color. Thus, a rotary developing apparatus has been developed, which comprises a plurality of developing devices containing a plurality of developers, one for one, different in color, and a rotary in which the plurality of developing devices are held so that the developing devices can be sequentially moved, by rotating the rotary, to the development position in which the developing means of any of the plurality of developing apparatuses can be virtually, or actually, in contact with the peripheral surface of the photosensitive member of the image forming apparatus, in order to develop the latent image on the photosensitive drum with the use of one of the developers in the plurality of developing devices.

There have been proposed various structural arrangements which make it possible to mount a plurality of developer supply containers in a rotary developing apparatus such as the one described above, along with a plurality of developing devices, so that the developers in the developer supply containers can be sent into the corresponding developing devices by orbitally moving the combination of the developing devices and corresponding developer supply containers, about the axial line of the rotary, by rotating the rotary. Some of these structural arrangements have been put to practical use.

The following are some of the above mentioned structures for a rotary developing apparatus in accordance with the prior art. Japanese Laid-Open Patent Application 8-44183, for example, discloses a rotary developing apparatus comprising a rotary and a plurality of developer supply containers stationarily held in the rotary. Each of the developer supply containers is provided with a plurality of ridges, which are located within the container to guide the developer toward the developer outlet of the container. Each developer supply container is stationarily mounted in the rotary, and is stationarily attached to the corresponding developing device in the rotary. Thus, as the rotary is rotated, each developer supply container is orbitally moved about the rotational axis of the rotary, and as the developer container is orbitally moved, the developer therein is conveyed to the outlet of the container by the plurality of internal ridges in the container, and is discharged from the container.

Japanese Laid-open Patent Application 8-328346 discloses another developer supply container structure. In this case, the developer supply container is provided with a partitioning wall as a developer barrier, which is located in the downstream adjacencies of the developer outlet, in terms of the rotational (orbital) direction of the container, in order to prevent the developer in the container from moving across the developer outlet as the container is rotated by being orbitally moved by the rotary, and also to assure that the developer in the container will converge to the developer outlet even after the amount of the developer in the container is substantially reduced.

Further, in the case of the developer supply container structure disclosed in Japanese Laid-open Patent Application 6-102758, in order to discharge the developer in a developer supply bottle at a stable rate, the developer supply bottle is provided with a metering portion, which is positioned in the adjacencies of the developer outlet of the bottle in a manner to surround the outlet from inside or outside of the bottle.

The above described developer supply containers in accordance with the prior art, however, had the following problems.

The structure disclosed in above mentioned Japanese Laid-open Patent Application 8-44183 is difficult to apply to a developer supply container, the dimension of which parallel with its axial line is extremely long relative to the dimension thereof perpendicular to the axial line thereof. More specifically, if the structure is applied to such a developer supply container, the angle of each of the above described ridges becomes too small to efficiently convey the developer in the container.

In the case of the structures disclosed in the abovementioned Japanese Laid-open Patent Applications 8-328346 and 6-102758, the developer becomes somewhat compressed in the adjacencies of the developer outlet, and is discharged in this somewhat compressed state. Thus, there is the possibility that if the developer outlet is small, it is plugged up with the developer, preventing the developer from being discharged.

SUMMARY OF THE INVENTION

The primary object of the present invention is to provide a developer supply container stable in the rate at which developer is discharged therefrom, throughout its usage, even after the amount of the developer remaining therein becomes small.

Another object of the present inventions is to provide a developer supply container drastically smaller, in the amount of the developer in the container which cannot be discharged, than a developer supply container in accordance with the prior art.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. The measurements, materials, shapes, and positioning of the structural components in the following embodiments are not intended to limit the scope of the present invention, unless specifically noted. They are rather to be modified in accordance with the structure of an apparatus to which the present invention is applied, and also, the various conditions under which the present invention is applied.

Embodiment 1

Figure 1:
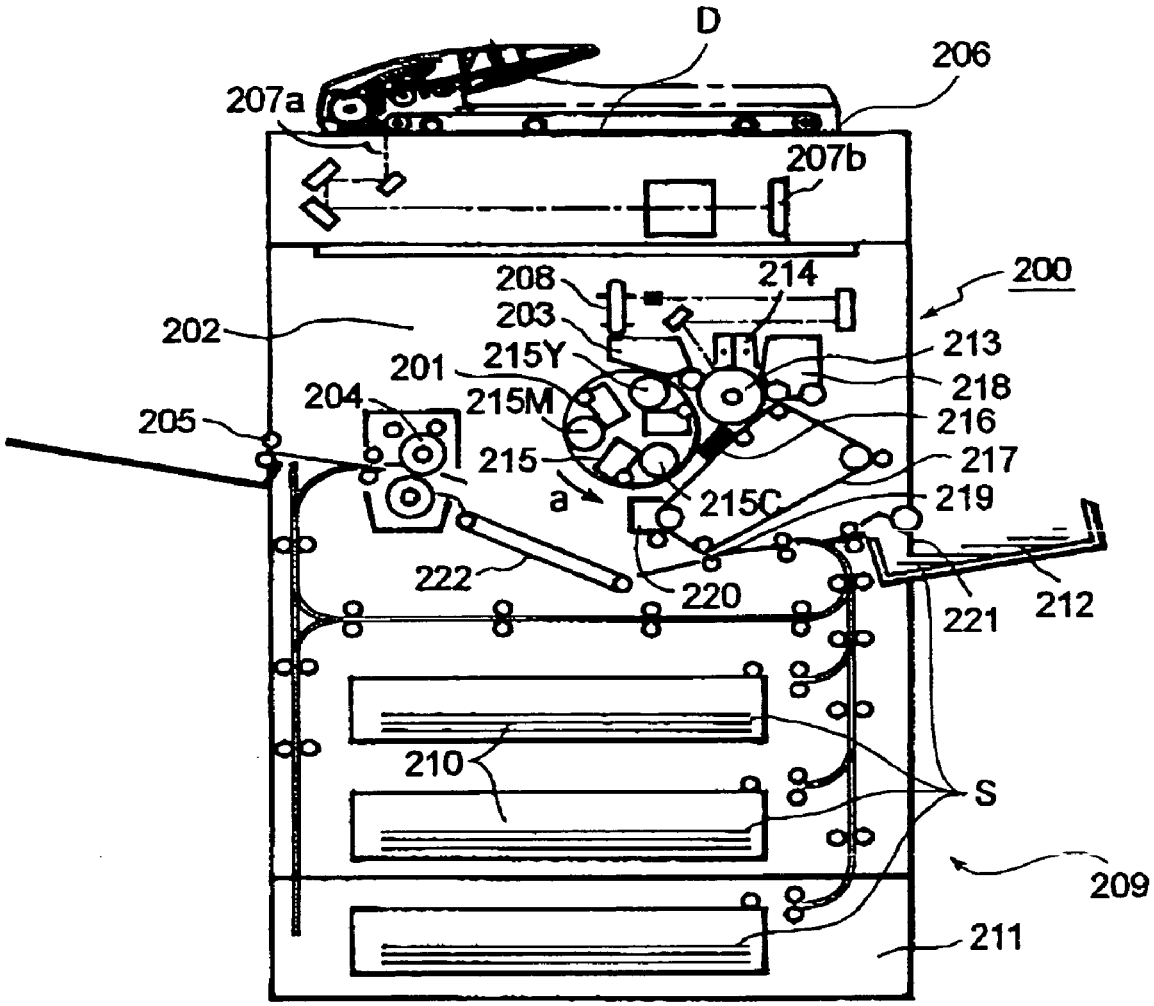
FIG. 1 is a schematic sectional view of the image forming apparatus equipped with a rotary capable of holding a plurality of developer supply containers.

First, referring to FIG. 1, a typical electrophotographic image forming apparatus to which the developer supply container in this embodiment is mountable will be described regarding its structure. FIG. 1 shows a color copying machine as an example of a multicolor image forming apparatus equipped with a rotary developing apparatus.

The image forming apparatus shown in FIG. 1 is a multicolor image forming apparatus, the main assembly 200 of which has a development rotary 201.

The main assembly 200 of the image forming apparatus comprises an original placement platen 206, a light source 207*a*, a CCD unit 207*b*, a laser scanner unit 208, a recording medium feeding portion 209, an image forming portion 202, etc. The recording medium feeding portion 209 comprises: a pair of recording medium cassettes 210 and 211 which are for storing recording medium S and are removably mountable in the main assembly 200; and a manual feeder tray 212 removably attachable to the main assembly 200. The recording medium S is fed into the main assembly 200 from the pair of cassettes 210 and 211, or the manual feeder tray 212.

The image forming portion 202 comprises: a black developing device 203 structurally independent from the rest of developing devices; a cylindrical photosensitive drum 213; a primary charging device 214; a development rotary as a rotatable member which internally holds a plurality of developing devices 215 (215Y, 215M, and 215C in FIG. 1) to which a plurality of developer supply containers (toner cartridges) are to be removably attached, one for one; a post-image formation charging device 216 for adjusting the quality of an image after development; an endless transfer belt 217 onto which four toner images different in color are transferred in layers to form a multicolor image thereon, and from which the multicolor image is transferred onto transfer medium; a drum cleaner 218 for cleaning the toner particles remaining on the peripheral surface of the photosensitive drum 213; a secondary transfer roller 219 for transferring the multicolor image (combination of toner images) from the transfer belt 217 onto the transfer medium; a belt cleaner 220 for removing the toner particles remaining on the transfer belt 217; etc.

Disposed upstream of the image forming portion 202 is a pair of registration roller 221 which rectifies the recording medium in attitude and position, and releases the recording medium with such timing that assures that the arrival of the toner images on the recording medium at a predetermined point synchronizes with the arrival of the recording medium thereat. Disposed downstream of the image forming portion 201 are: a transfer conveyance apparatus 222 for conveying the transfer medium S after the transfer of the toner images onto the recording medium S; a fixing apparatus for fixing the unfixed toner images on the transfer medium S to the transfer medium S; a pair of discharge rollers 205 for discharging the transfer medium S from the main assembly 200 of the image forming apparatus, after the fixation of the toner images to the transfer medium S; etc.

Next, the operation of the image forming apparatus will be described.

As a signal for feeding the recording medium S is outputted from the unshown controlling apparatus with which the main assembly 200 is provided, a single or a plurality of transfer mediums S are fed into the main assembly 200 from the cassettes 210 or 211, or manual feeder tray 212. Meanwhile, the light projected from the light source 207*a* onto the original D on the original placement platen 206 and reflected by the original is read and converted into electrical signals by the CCD unit 207*b*. The electrical signals are converted into a beam of laser light which reflects the electrical signals, and is projected onto the peripheral surface of the photosensitive drum 213, the peripheral surface of the photosensitive drum 213 has been charged in advance by the primacy charging device 214. Therefore, as the peripheral surface of the photosensitive drum 213 is exposed to this beam of laser light, an electrostatic latent image is formed on the peripheral surface of the photosensitive drum 213. Then, the electrostatic latent image is developed by the black developing device 203, or one of the plurality of developing devices 215 held in the development rotary 201, into an image formed of the toner (toner image) of a specific color.

After the formation of a toner image on the peripheral surface of the photosensitive drum 213, the toner image is adjusted by the post-image formation charging device 216, and then, is transferred onto the transfer belt 217, in the transfer station. When the multicolor image forming apparatus is in the color mode, the transfer belt 217 is rotated one full turn, with the toner image kept untouched on the transfer belt 217, in order to allow the next toner image to be transferred in layers onto the first toner image on the transfer belt 217. Meanwhile, the development rotary 201 is rotated in the direction indicated by an arrow mark a to place the developing device to be used for the formation of the next toner image, in the position in which the developing means of the developing device is placed virtually, or actually, in contact with the peripheral surface of the photosensitive drum 213, preparing the image forming apparatus for the formation of the next toner image. As will be evident from the above description, when the image forming apparatus is in the full-color mode, the sequence comprising the electrostatic latent image formation step, development step, and transfer step is repeated until the formation of a predetermined number of toner images necessary to form a single full-color image is completed.

The transfer medium S fed from the recording medium feeding portion 209 is rectified in attitude by the pair of registration rollers 221, if it was fed askew. Then, it is released, with predetermined timing, to be conveyed to the image forming portion 202. Then, the toner images are transferred onto the recording medium S by the secondary transfer roller 219. Thereafter, the recording medium S is separated from the transfer belt 217, and is conveyed by the transfer conveyance apparatus 204, in which the unfixed toner images on the transfer medium S are permanently fixed by the heat and pressure from fixing apparatus 204. After being fixed, the recording medium S is discharged by the pair of discharge rollers 205 from the apparatus main assembly 200.

As described above, the recording medium S fed into the main assembly 200 from the recording medium feeding portion 209 is discharged from the main assembly 200 after the formation of a multicolor image on the recording medium S.

Referring to FIG. 1, the developing apparatus is structured so that the yellow (Y) developing device 215Y, magenta (M) developing device 215M, and cyan (C) developing device 215C are held in the development rotary 201, in the listed order, in terms of the rotational direction of the rotary 201, so that they are used for development in this order. In this embodiment, the rotational direction of the development rotary 201 is counterclockwise as seen from the front side of the main assembly 200. However, the rotational direction of the development rotary 201 should be determined based on the positional relationship between the developing device 215 and photosensitive drum 213, the development condition, etc. In other words, the rotational direction of the development rotary 201 does not need to be limited to the above mentioned direction, which is obvious.

As for the removably mountable developer supply containers (FIG. 2) which will be described later in detail, they are internally and stationarily held along with the corresponding developing devices 215Y, 215M, and 215C, by the development rotary 201. Each developer supply container 1 is structured so that as it is orbitally moved by the rotation of the development rotary 201 about the axial line of the rotary 201 during image formation, the developer in the developer supply container is conveyed therein and is discharged therefrom.

Further, each developer supply container is structured so that it can be easily replaced by temporarily stopping the rotation of the development rotary 201, as it become necessary, for example, if the amount of the developer in the developer supply container has reduced to a critical level.

As for the developer conveyance in the developer supply container 1, the developer supply container 1 is structured so that as the developer rotary 201 is rotated, the developer in the developer supply container 1 is conveyed toward the developer outlet located at one of the lengthwise ends of the developer supply container 1. With the provision of this structural arrangement, the developer can be supplied, as necessary, from developer supply container 1 to the corresponding developing device through the joint between the abovementioned developer outlet of the developer supply container 1 and the developing device 215.

(Structure of Developer Supply Container)

Figure 2:
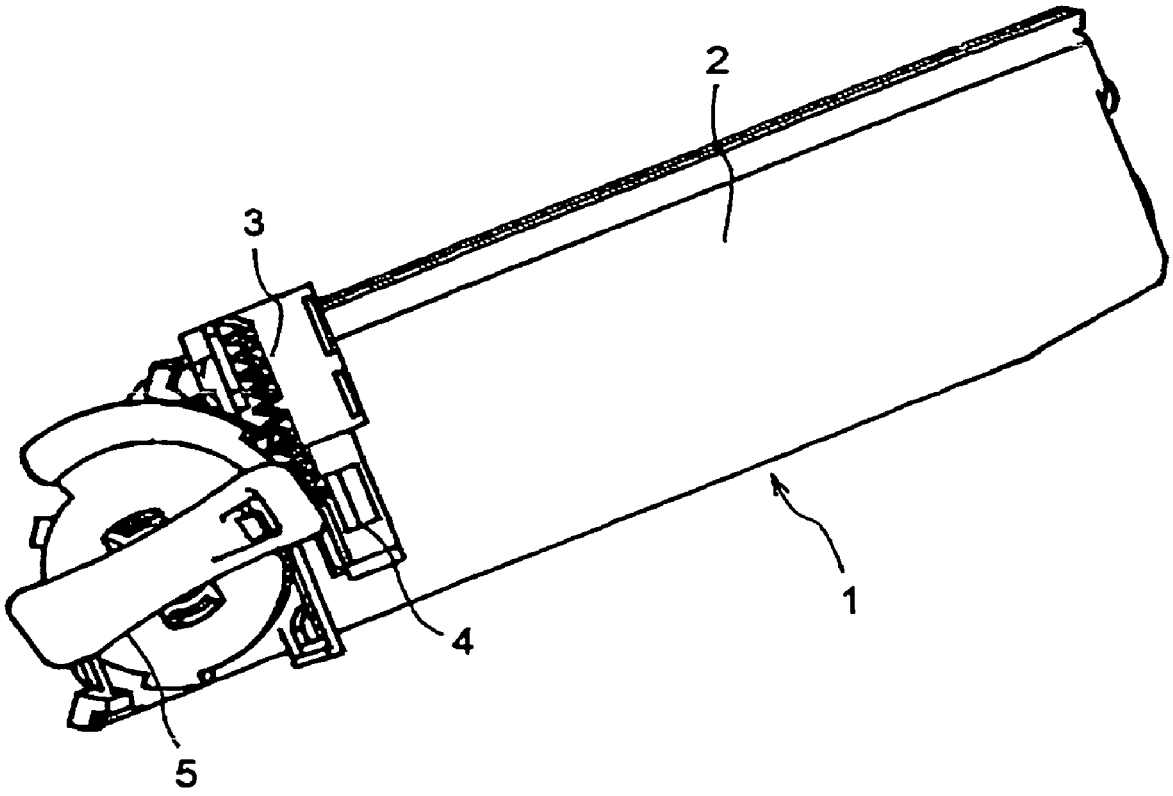
FIG. 2 is a perspective view of the developer supply container in the first embodiment of the present invention.

Referring to FIG. 2, designated by a referential number 1 is a developer supply container, in the first embodiment of the present invention, which is hollow and cylindrical. This developer supply container 1 comprises a container proper 2, a shutter 3, a sealing member 4, a knob 5, etc.

(Container Proper)

Figure 3:
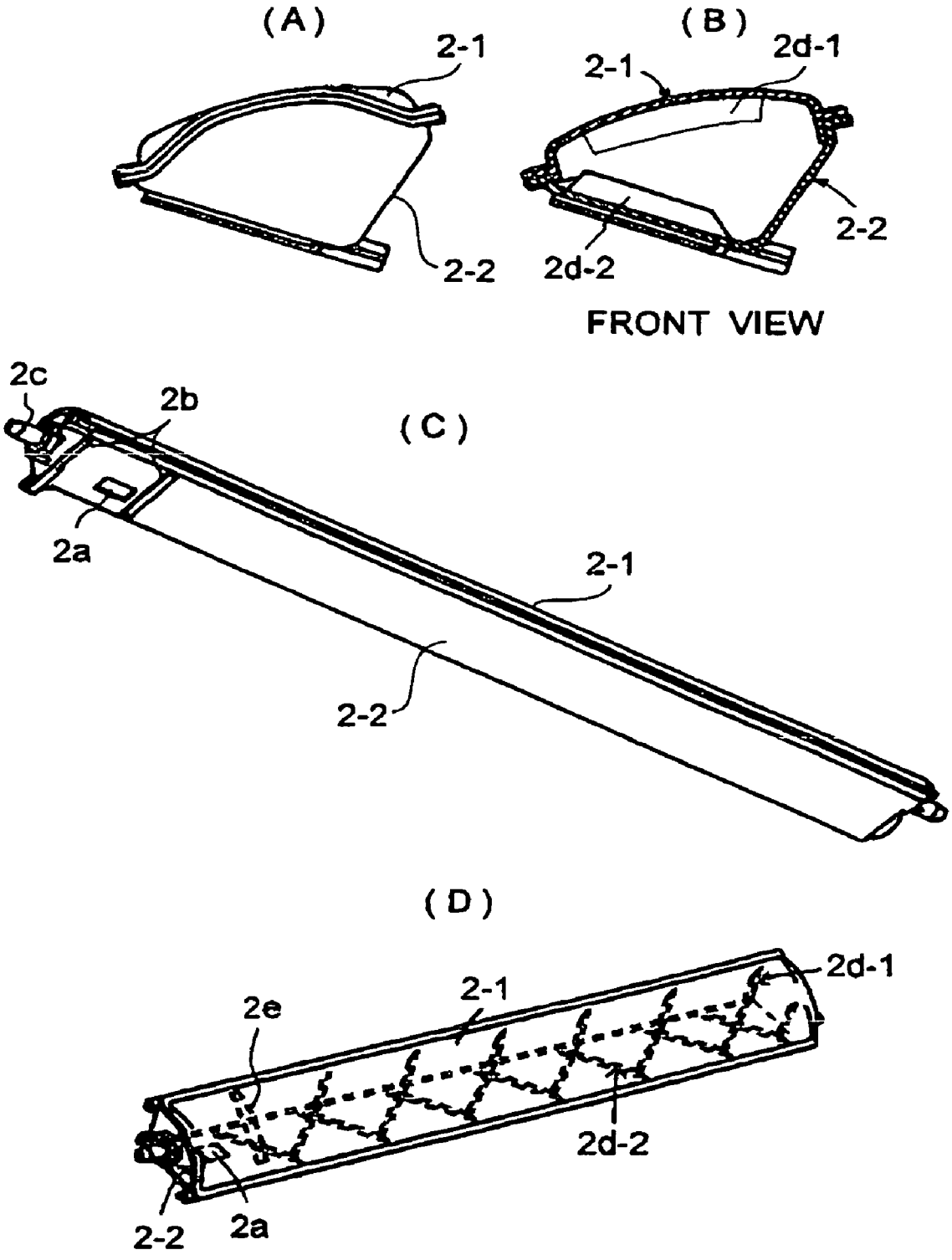
FIG. 3(A) is a front view the container proper of the developer supply container in the first embodiment.
FIG. 3(B) is a sectional view of the container proper of the developer supply container, parallel to the front panel of an image forming apparatus.
FIG. 3(C) is a perspective view of the container proper of the developer supply container.
FIG. 3(D) is a phantom perspective view of the container proper of the developer supply container in the first embodiment.

Next, referring to FIG. 3, the structure of the container proper 2 of the developer supply container 2 will be described. FIG. 3(A) is a front view of the container proper 2 of the developer supply container 1, and FIG. 3(B) is a sectional view thereof, parallel with the front panel of the main assembly 200 of the image forming apparatus. FIG. 3(C) is a perspective view of the container proper 2, and FIG. 3(D) is a phantom perspective view of the container proper 2, the internal members of which are contoured by broken lines.

The container proper 2 is provided with a developer outlet 2*a*, a shutter guide 2*b*, a knob guide 2*c*, a set of conveyance ridges 2*d*-1 as a developer conveying means, and a set of conveyance ridges 2*d*-2 as a developer conveying means.

The shape of the cross section of the container proper 2 is optional. In other words, it may be of any shape as long as the shape makes it possible to make effective use of the limit internal space of the rotary in order to maximize the amount by which developer is storable in the container proper 2. The container proper 2 of the developer supply container 1 in this embodiment is shaped so that its sectional view perpendicular to the lengthwise direction of the container proper 2 becomes non-circular. More specifically, it is roughly in the form of a triangular pillar as shown in FIG. 3. Further, the developer supply container 1, in this embodiment, which is to be mounted in the developer rotary 201 is roughly in the form of a pipe, the length of which is roughly equal to the dimension of the image formation range of the main assembly (development range of developing device) in terms of the direction perpendicular to the recording medium conveyance direction.

Shaping the container proper 2 so that the contour of its cross section becomes non-circular makes it possible to make more efficient use of the limited internal space of the rotary in which the developer supply container 1 is removably mounted. In other words, it makes it possible to increase the amount by which each of the plurality of developer supply containers 1 identical in shape can hold developer.

Figure 4:
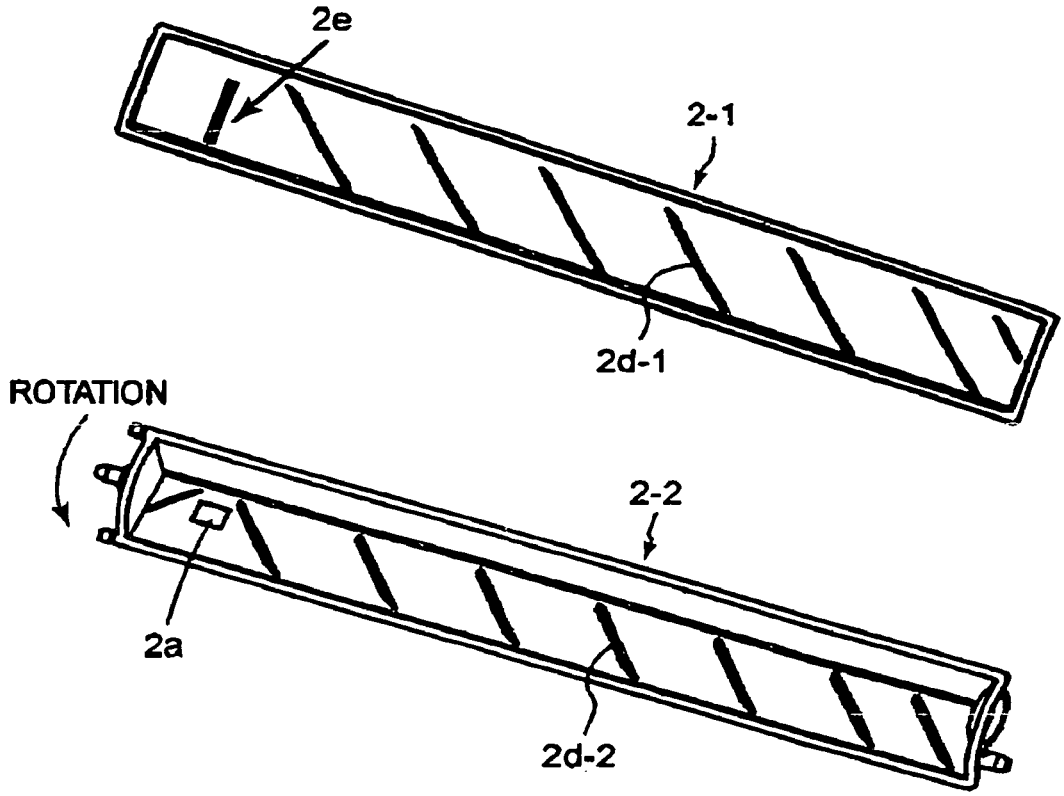
FIG. 4 is a schematic drawing of the top and bottom sections of the developer supply container in the first embodiment, as seen from the direction in which the two sections are to be removed from the metallic molds thereof.
Figure 5:
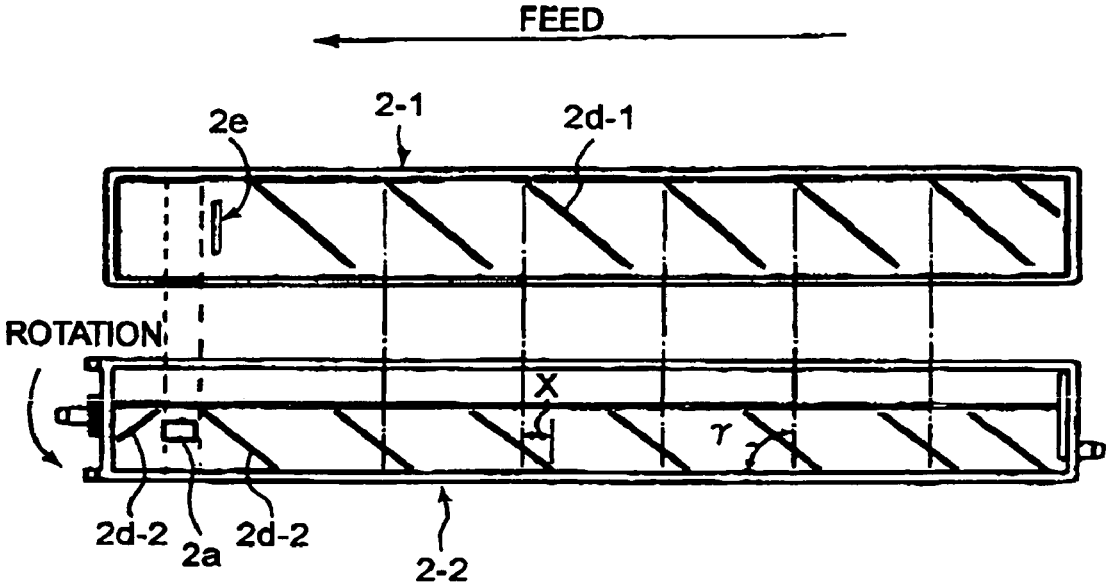
FIG. 5 is a schematic drawing of the top and bottom sections of the developer supply container in the first embodiment of the present invention, showing the structures thereof.

In this embodiment, the container proper 2 is essentially formed of two sections: top and bottom sections 2-1 and 2-2 (FIGS. 4 and 5). The two sections are separately molded of resin, and are ultrasonically welded to each other without leaving any gap at the welding seam.

The developer outlet 2*a* is in one of the side walls of the container proper 2, and is located near one of the lengthwise ends of the container proper 2. The developer in the container proper 2 is discharged from the developer outlet 2*a* into the developing device 215 of the apparatus main assembly 200 through the joint between the container proper 2 and developing device 215.

The portion of the container proper 2 having the developer outlet 2*a* is the side wall of the container proper 2, which will be next to the peripheral portion of the rotary positioned virtually and parallel therewith after the mounting of the developer supply container 1 into the rotary, as described above. Thus, as the development supply container is positioned by the rotation of the rotary so that the developer outlet 2*a* faces downward, the developer in the container proper 2 naturally falls (discharges) from the developer supply container through the developer outlet 2*a*. Therefore, the developer container in this embodiment is smaller in the amount of the developer in a developer which cannot be discharged therefrom than a developer supply container, in accordance with the prior art, having its developer outlet in one of the lengthwise end walls.

Also, the developer supply container 1 in this embodiment is smaller, in the extent of the soiling of the image forming apparatus resulting from the scattering of the developer, than a developer supply container, the developer outlet 2*a* of which extends from one lengthwise end of the container proper 2 to the other.

(Developer Conveyance Ridges)

The configuration of the means for conveying the developer in the container proper 2 toward the developer outlet 2*a* of the container proper 2 is optional. For example, the means for conveying the developer in the container proper 2 may be in the form of a spiral groove, a spiral ridge, or the like. In terms of the developer conveyance efficiency, the means for conveying the developer in the container proper 2 is desired to be structured as in this embodiment. Next, the means, in this embodiment, for conveying the developer in the container proper 2 will be described in detail.

Incidentally, the direction in which the developer in the developer supply container 1 is conveyed by the developer conveying means is roughly parallel with the lengthwise direction of the developer supply container 1.

The container proper 2 is provided with a two sets of developer conveyance ridges for conveying the developer in the container proper 2 to the developer outlet 2*a*. The developer conveyance ridges are on the internal surfaces of the container proper 2. More specifically, a set of developer conveyance ridges 2*d*-1 is on the internal surface of the aforementioned top section 2-1 of the container proper 2, and a set of developer conveyance ridges 2*d*-2 is on internal surface of the bottom section 2-2 of the container proper 2. The rotational direction of the developer supply container 1 is the direction indicated by an arrow mark in FIG. 4.

The developer conveyance ridges 2*d*-1 of the top section 2-1 and the developer conveyance ridge 2*d*-2 of the bottom section 2-2 are tiled so that their lengthwise ends on the developer outlet side trail their opposite lengthwise ends when the developer supply container 1 is rotated.

Referring to FIG. 5, the angle Y or the developer conveyance ridges 2*d*-1 and 2*d*-2 relative to the rotational axis of the developer supply container 1 is desired to be in the range of 20°–70°, preferably, 40°–50°. In this embodiment, the angle Y of the developer conveyance ridges 2*d*-1 and 2*d*-2 relative to the rotational axis of the developer supply container 1 is 45°.

If the angle Y of the developer conveyance ridges 2*d*-1 and 2*d*-2 is no more than 20°, it is difficult for the developer to slide downward on the developer conveyance ridges; in other words, the developer conveyance ridges do not efficiency convey the developer. On the other hand, if it is no less than 70°, it requires a greater number of developer conveyance ridges to convey the developer from one lengthwise end of the developer supply container 1 to the other, reducing the internal space of the developer supply container 1.

This is why the angle Y of the developer conveyance ridges 2*d*-1 and 2*d*-2 is desired to be in the range of 20°–70°, preferably, 40°–50°, in order to satisfactorily convey the developer in the developer supply container 1.

Each of the developer conveyance ridges 2*d*-1 of the top section 2*d*-1 of the container proper 2 and each of the developer conveyance ridges 2*d*-2 of the bottom section 2-2 of the container proper 2 are in the form of such a flat and narrow rectangular plate (in the form which appears as a straight line in the drawing), as shown in FIG. 5, that has no undercut as seen from the directions in which the molds of the top and bottom sections 2-1 and 2-2 of the container proper 2 are to be removed when forming the top and bottom sections 2-1 and 2-2. This simplifies the structure of the metallic molds for the top and bottom sections 2-1 and 2-2 of the container proper 2, reducing thereby the manufacturing cost of a developer supply container.

The positional relationship between the set of developer conveyance ridges 2-1 of the top section 2-1 of the container proper 2 and the set of the developer conveyance ridges 2-2 of the bottom section 2-2 of the container proper 2 is as shown in FIG. 5. In other words, the two sets of developer conveyance ridges 2*d* are placed offset relative to each other in terms of the develop conveyance direction. Thus, in terms of the direction perpendicular to the developer conveyance direction, the intervals of the developer conveyance ridges 2*d*-1 of the top section 2-1 align with the developer conveyance ridges 2*d*-2 of the bottom section 2-2, one for one, and the intervals of the developer conveyance ridges 2*d*-2 of the bottom section 2-2 align with the developer conveyance ridges 2*d*-1 of the top section 2-1; in other words, the developer conveyance ridges 2*d*-l and developer conveyance ridges 2*d*-2 partially overlap with each other in terms of the direction perpendicular to the developer conveyance direction. The amount by which the two sets of developer conveyance ridges partially overlap with each other is designated by a referential symbol X in FIG. 5. With the provision of the above described structural arrangement, as a given developer supply container 1 in the rotary is orbitally moved by the rotation of the rotary about the rotational axis of the rotary, it is assured that the developer in the developer supply container 1 is conveyed to the developer outlet 2*a* by the developer conveyance ridges 2*d*-l and 2*d*-2 of the top and bottom sections 2-1 and 2-2, respectively, of the developer supply container 1 while being moved back and forth between the set of developer conveyance ridges 2*d*-1 and the set of developer conveyance ridges 2*d*-2. Therefore, the problem that a developer supply container is reduced in developer conveyance performance because the developer slips through the intervals of the developer conveyance ridges does not occur. Further, there is an additional benefit that the developer is increased in fluidity by the aforementioned overlapping portions of the developer conveyance ridges (end portions of developer conveyance ridges, which overlap with end portions of the developer conveyance ridges on opposite section of developer supply container).

As described above, in this embodiment, the container proper 2 of the developer supply container 1 is provided with the set of developer conveyance ridges 2*d*-1, which is placed on the internal surface of the top section of the container proper 2, and the set of developer conveyance ridges 2*d*-2, which is placed on the internal surface of the bottom section of the container proper 2. Further, the set of the developer conveyance ridges 2*d*-1 and the set of the developer conveyance ridges 2*d*-1 are positioned offset relative to each other in terms of the developer conveyance direction, so that the range in which the developer in the developer supply container 1 is conveyed by the set of developer conveyance ridges 2*d*-1 and the range in which the developer is conveyed by the set of developer conveyance ridges 2*d*-2 overlap with each other in terms of the direction perpendicular to the rotational axis of the rotary. Therefore, even if the developer in the developer supply container 1 is agglomerated and/or compacted because of the vibrations to which the developer supply container 1 is subjected during transportation, the harsh environment in which the developer supply container 1 may be left or stored unattended, and the like reasons, the developer in the developer supply container 1 is loosened, being enabled to be smoothly discharged through the developer outlet 2*a*, because it is moved back and forth between the two sets of developer conveyance ridges while it is conveyed toward the developer outlet 2*a* by the two sets of developer conveyance ridges, as the developer supply container 1 is rotated by being orbitally moved by the rotation of the rotary.

As for the positional relationship between the pair of developer conveyance ridges 2*d*-2 of the bottom section 2-2 of the container proper 2, positioned next to the developer outlet 2*a* of the bottom section 2-2 in a manner to sandwich the developer outlets 2*a*, and the developer outlet 2*a*, the pair of developer conveyance ridges 2*d*-2 are positioned so that after the developer in the developer supply container 1 is conveyed to the lengthwise end of the developer supply container i, where the developer outlet 2*a* is located, the developer is partially guided to the downstream side of the developer outlet 2*a* in terms of the rotational direction of the developer supply container 1. In other words, not all of the developer is discharged through the developer outlet 2*a* after it is conveyed to the developer outlet 2*a*. The portion of the developer, which was not discharged through the developer outlet 2*a* during the first rotation of the developer supply container 1 is returned to the upstream side of the developer outlet 2*a* by the rotation of the developer supply container 1, and mixes with the next body of developer having just been conveyed to the adjacencies of the developer outlet 2*a*. Then, the mixture of the part of the first body of developer delivered to the adjacencies of the developer outlet 2*a* and the second body of developer delivered to the adjacencies of the developer outlet 2*a* is partially discharged through the developer outlet 2*a*. The rest is guided to the downstream side of the developer outlet 2*a*, and is returned to the upstream side of the developer outlet 2*a* by the rotation of the developer supply container 1, mixing into the next body of developer. This process is repeated until virtually the entirety of the developer in the container proper 2 is consumed. In other words, as a give body of the developer in the container proper 2 is conveyed to the developer outlet 2*a*, the given body of developer is partially tumbled in the developer supply container 1, and while it is tumbled, it is stirred, being thereby loosed, by the developer conveyance ridges 2*d* on the internal walls of the developer supply container 1. Therefore, the body of developer in the adjacencies of the developer outlet 2*a* is always kept fluid. Therefore, the developer in the container proper 2 does not become compacted in the adjacencies of the developer outlet 2*a*. Thus, the problem that the developer outlet 2*a* is plugged up by the developer as the developer is conveyed to the developer outlet 2*a* does not occur.

Since the body of developer in the adjacencies of the developer outlet 2*a* remains loose by being constantly stirred, a part of it is always smoothly discharged through the developer outlet 2*a*. Further, when the developer in the developer supply container 1 is discharged into the developing device 1 through the developer outlet 2*a* while going through the above described process, it more easily mixes with the developer in the developing device. The above described structural arrangement for a developer supply container is particularly beneficial when the developing device 1 is designed to use such developer that is a mixture of toner and carrier, because the easier for toner to mix with carrier, the faster and more uniformly the toner is electrically charged.

Incidentally, the developer conveying internal means of the container proper 2 does not need to be limited to the above described one. For example, the developer supply container 1 may be provided with a single or plurality of internal plates, which extend in the lengthwise direction of the developer supply container 1 and have a plurality of tilted ridges, so that as the development rotary is rotated, the developer in the developer supply container is conveyed toward the developer outlet of the developer supply container by the combination of the internal plates and tilted ridges thereon.

(Partitioning Wall)

Referring to FIGS. 4 and 5, the top section 2-1 of the container proper 2 is provided with a partitioning wall 2*e*, as a developer movement checking member, for preventing the developer in the container proper 2 from moving in the direction opposite to the normal developer conveyance direction. The developer movement checking member is positioned on the upstream side of the developer outlet 2*a*, next to the developer outlet 2*a*. It is provided for preventing the problem that as the developer outlet 2*a* faces upward due to the rotation of the rotary 201, a part of the developer having fallen into the container proper 2 falls back into the container proper 2 and flows therein in the direction opposite to the direction in which the developer is conveyed by the set of developer conveyance ridges 2*d*-1 and set of developer conveyance ridges 2*d*-2. The partitioning wall 2*e* is one of the integral parts of the top section 2-1 of the container proper 2, and is integrally formed therewith.

In this embodiment, the partitioning wall 2*e* projects perpendicular to the internal surface of the top section 2-1, and extends in the direction perpendicular to the direction in which the developer is conveyed by the developer conveyance ridges 2*d*-1 and 2*d*-2 (direction roughly perpendicular to the lengthwise direction of developer supply container 1). The partitioning wall 2*e* is formed as one of the integral parts of the top section 2-1 of the container proper 2. It will be described later in more detail.

(Method for Manufacturing Container Proper of Developer Supply Container)

A developer supply container is formed in two or more sections by injection molding, extrusion molding, blow molding, or the like, and the two or more sections are welded or glued together to yield the developer supply container. The developer supply container 1 in this embodiment is made using the following method. That is, first, the top and bottom sections 2-1 and 2-2 are separately molded by injection molding, and then, they are welded together by an ultrasonic welder. The material for the developer supply container 1 in this embodiment is shock resistant polystyrene. However, the material for the developer supply container 1 may be different from that used in this embodiment.

(Shutter)

Referring to FIG. 2, the shutter 3 comprises a shutter proper, and a pair of guiding portions which are U-shaped in cross section. The shutter proper is an arcuate plate, the curvature of which matches the curvature of the wall of the container proper 2 having the developer outlet 2*a*. The guiding portions are attached to the two edges of the shutter proper, one for one, which are perpendicular to the lengthwise direction of the container proper 2. The two guiding portions engage with the two shutter guides 2*b*, one for one, which are extended parallel to the circumferential direction of the rotary. Therefore, the shutter 3 can be moved along the external surface of the wall of the container proper 2 having the developer outlet 2*a*, in the circumferential direction of the rotary.

There is a sealing member 4 between the shutter 3 and container proper 2. The sealing member 4 seals the developer outlet 2*a* by being compressed against the container proper 2 by the shutter 3.

(Method for Manufacturing Shutter)

The material for the shutter 3 is desired to be plastic, and the method for manufacturing the shutter 3 is desired to be injection molding. However, they may be different from the plastic and injection molding. The material for the shutter 3 is desired to be a substance having a certain amount of rigidity. In this embodiment, the shutter 3 is injection molded of highly slippery ABS.

(Sealing Member)

Referring to FIG. 2, the sealing member 4 is placed on the container proper 2 in a manner of surrounding the developer outlet 2*a* of the container proper 2. It seals the developer outlet 2*a* by being compressed by the container proper 2 and shutter 3. The material for the sealing member 4 is optional; one of the various known foamed materials or elastic materials can be used. In this embodiment, foamed urethane is used.

(Knob)

Referring to FIG. 2, the knob 5 comprises a knob proper and a cylindrical portion. The cylindrical portion has double walls (unshown). The external wall of the cylinder has a gear portion cut across the peripheral surface thereof, and the internal wall of the cylinder has claws which engage with the circular projections of the lengthwise end of the container proper 2. The knob 5 is attached to the front end of the container proper 2 by these claw so that it can be rotated back and forth in the circumferential direction of the container proper 2. In this embodiment, the knob 5 also is formed of impact resistant polystyrene by injection molding.

The configuration of the developer supply container 1 removably mountable in the rotary does not need to be limited to the above described one (first embodiment). For example, it may be such a configuration as that of the developer supply container in the second embodiment of the present invention, which will be described later.

(Mounting of Developer Supply Container into Image Forming Apparatus)

Next, the mounting of the developer supply container in this embodiment into an image forming apparatus, and the operation of the developer supply container 1 in the image forming apparatus, will be described.

First, the developer supply container 1 is to be inserted into the rotary of the image forming apparatus main assembly, with the knob 5 (developer outlet side) facing frontward.

Next, the knob 5, which is on the front side of the container proper 2, is to be rotated by a predetermined angle in the direction indicated by an arrow mark, by holding the knob proper. As the knob 5 is rotated, the rotation of the knob 5 is transmitted by the above described gear of the knob 5 is transmitted by the above described gear of the knob 5 to the gear of the shutter 3 through the gear(s) on the main apparatus side. As a result, the shutter 3 is opened.

The position in the image forming apparatus, into which the developer supply container 1 is to be mounted, and the method for mounting the developer supply container 1 into the image forming apparatus, do not need to be limited to the above described ones; they are optional, and may be selected in accordance with the structure of the main assembly of the image forming apparatus.

The developer supply container 1 is mounted in the rotary so that it remains stationary relative to the rotary. It is orbitally moved by using the rotation of the rotary. Therefore, it is unnecessary to provide the developer supply container 1 with the structure for rotationally driving the contained 1. In other words, this embodiment makes it possible to reduce the cost of the developer supply container 1, as well as the cost of the main assembly of an image forming apparatus.

(Operation)

Figure 6:
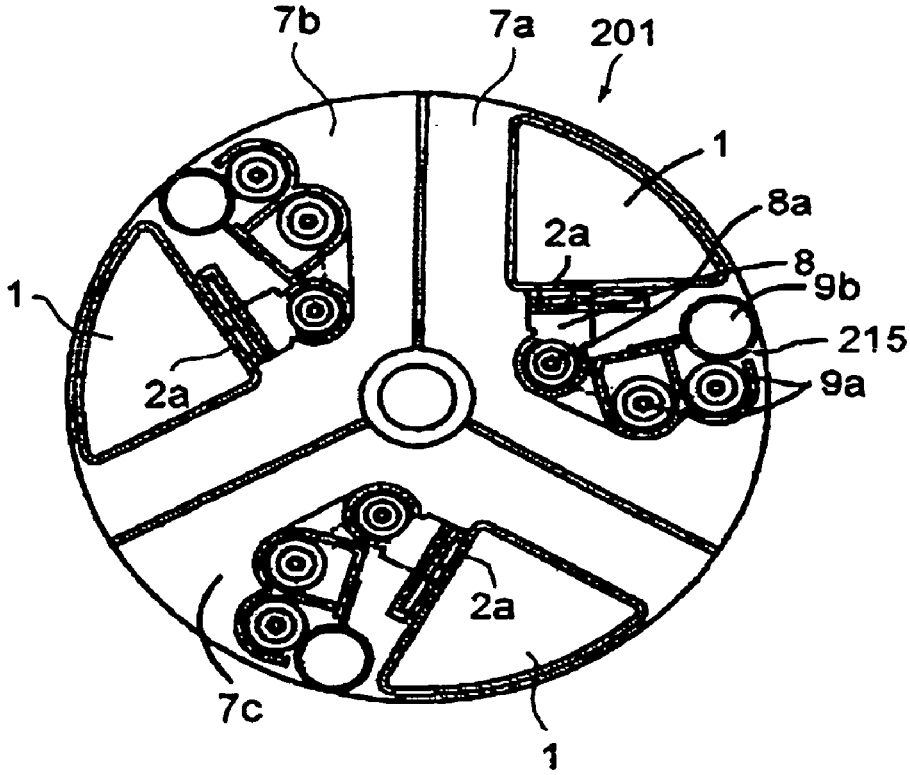
FIG. 6 is a sectional view, parallel with the front panel of the image forming apparatus, of the combination of the rotary, the internal space of which are partitioned in three.

Next, referring to FIG. 6, what occurs in the developer supply container 1 as the rotary (development rotary) 201 is rotated will be described.

First, the structure and operation of the rotary 201 will be described with reference to FIG. 6. The internal space of the rotary 201 shown in FIG. 6 is divided in three sections, in which three color developing devices 215Y, 215M, and 215C, and three developer supply containers 1 roughly triangular in cross section, are held one for one.

The rotary 201 is structured so that in order to switch a given developing device 215 with the developing device 215 next in line in the image formation sequence, the rotary 201 is to be rotated 120° in the counter clockwise direction of the drawing. In this embodiment, the position 7*a* in the drawing is the position in which a given developing device 215 opposes the photosensitive drum. Hereinafter, this position 7*a* will be referred to as "development station 7*a*". Further, the votary and main assembly of the image forming apparatus are structured so that the force for driving the developer conveyance portion 9*a* and development sleeve 9*b* of the developing device 215 can be transmitted to the driving conveyance portion 9*a* and development sleeve 9*b* only when the developing device 215 is in the development station 7*a*. When a developing device 215 is in the positions other than the development station 7*a*, it does not operate; the developing devices 215 which are in the positions 7*b* and 7*c* in the drawing, do not operate.

The developer supply container 1 may be mounted or dismounted when it is in any of the three positions 7*a*, 7*b*, and 7*c*. However, it is preferable that the developer supply container 1 is mounted or dismounted in the positions other than the development station 7*a*. The most preferable position is the position 7*c*, because when the developer supply container 1 is in the position 7*c*, the developer outlet 2*a* faces upward. In this embodiment, the developer supply container 1 is mounted or dismounted in the position 7*c*.

Next, the movement of the developer in the developing device 215, which occurs when the developing device 215 is in the development station 7*a*, will be described. There is an intermediary developer chamber 8 between the developing device 215 and developer supply container 1. The intermediary developer chamber 8 catches the developer as the developer is discharged from the developer supply container 1, and temporarily holds it. There is a developer conveying member 8*a* in the intermediary developer chamber 8. As the developer conveying member 8*a* is rotated for a predetermined length of time, the developer in the intermediary developer chamber 8 is supplied to the developing device 215.

The amount of the developer in the intermediary developer chamber 8 reduces as the developing device 215 is operated in the development station 7*a*. As the amount of the developer in the intermediary developer chamber 8 reduces, the developer in the developer supply container 1 immediately falls, due to its own weight, into the intermediary developer chamber 8 through the developer outlet 2*a*; the intermediary developer chamber 8 is supplied with the developer from the developer supply container 1.

As described above, when a given developing device 215 is in the development station 7*a*, the developer supply container 1 connected to this developing device 215 is oriented so that its developer outlet 2*a* faces downward, that is, the direction in which gravity works, allowing therefore the developer therein to naturally fall (discharge). In other words, when the developing device 215 is in the development station 7*a*, in which developer is consumed, the developing device 215 is most efficiently supplied with the developer from the developer supply container 1.

Even if there is not a sufficient amount of the developer in the adjacencies of the developer outlet 2*a* of a given developer supply container 1, as the rotary 201 is rotated, the developer in the other portions of the internal space of the developer supply container 1 is conveyed to the lengthwise end portion (adjacencies of developer outlet 2*a*) of the container proper 2, by the functions of the aforementioned developer conveyance ridges. Therefore, by the time the developer supply container 1 is returned to the development station 7*a* by a full rotation of the rotary 201, the amount of the developer in the adjacencies of the developer outlet 2*a* becomes large enough to supply the intermediary developer chamber 8 with a sufficient amount of the developer.

The position in which the developer outlet 2*a* of the developer supply container 1 is to be placed in the development station 7*a* is desired to be directly above the intermediary developer chamber 8. However, it does not need to be, for the following reason. That is, even if the position in which the developer outlet 2*a* of the developer supply container 1 is placed in the development station 7*a* is such a position that does not allow the developer to free fall from the developer supply container 1 into the intermediary developer chamber 8, there is always one point in time at which the developer outlet 2*a* comes directly above the intermediary developer chamber 8, while the rotary is rotated one full turn. Therefore, the developer in the developer supply container 1 is allowed to free fall into the intermediary developer chamber 8 at this point in time while the rotary is rotated, even if the position in which the developer outlet 2*a* of the developer supply container 1 is placed in the development station 7*a* is such a position that does not allow the developer in the developer supply container 1 to free fall into the intermediary developer chamber 8.

In this embodiment, after the formation of every two A4 copies or a single A3 copy, the rotary is rotated by 120° to switch the developing device. The length of time it takes to rotate the rotary to switch the developing device is roughly 0.3 second, and the length of time the developing device is kept in the development station 7*a* is roughly 1.2 second. The peripheral velocity at which the rotary is rotated is roughly 0.7 m/sec. The diameter of the rotary is 145 mm.

Incidentally, the developer to be stored in the developer supply container 1 in this embodiment may be pure toner, or mixture of toner and carrier.

Next, referring to FIG. 7, the partitioning wall 2*e* in this embodiment will be described in detail.

Figure 7:
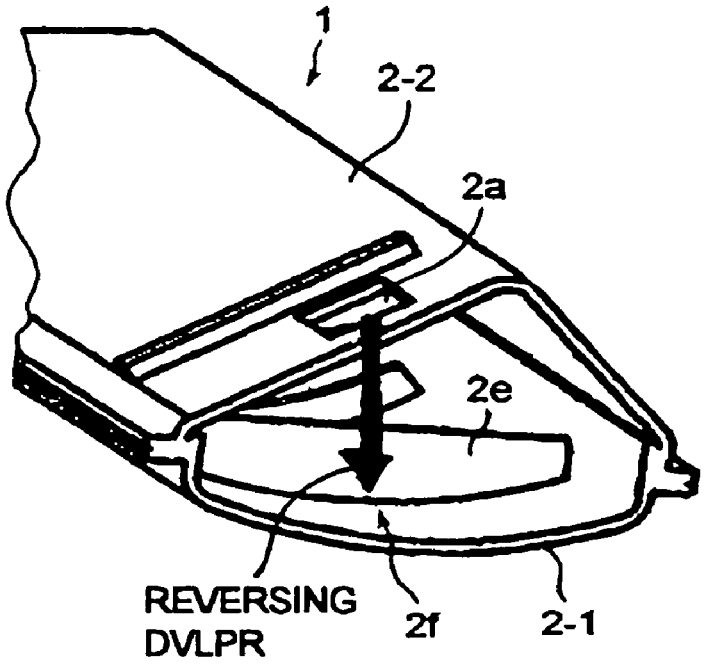
FIG. 7 is a perspective view of one of the lengthwise end portions of the developer supply container in the first embodiment, showing the developer outlet of the container, and the adjacencies of the partitioning wall of the container.

Occasionally, the developer having fallen into the intermediary developer chamber 8 through the developer outlet 2*a* partially flows back into the developer supply container 1 when the developer outlet 2*a* is made to face roughly upward, as shown in FIG. 7, by the rotation of the rotary. If this phenomenon occurs, the amount by which the developer is supplied from the developer supply container 1 to the developing device 215 reduces, creating the possibility that the developing device 215 cannot be reliably supplied with a necessary amount of the developer. This phenomenon is more likely to occur when the amount of the developer in the developer supply container 1 is smaller than a certain value.

Thus, in order to prevent this phenomenon, the developer supply container 1 is provided with a partitioning wall 2*e* as a member for preventing the developer having flowed back from the intermediary developer chamber 8 into the container proper 2 through the developer outlet 2*a* while the developer outlet 2*a* is facing upward during the rotation of the rotary, from moving in the direction opposite to the direction in which the developer in the developer supply container 1 is conveyed by the developer conveyance ridges 2*d*-1 and 2*d*-2. The partitioning wall 2*e* is placed on the internal surface of the top section 2-1 of the container proper 2, being positioned to oppose the developer outlet 2*a* of the bottom section 2-2 of the container proper 2. With the provision of this partitioning wall 2*e*, the developer having flowed back into the developer supply container 1 as described above is at least partially prevented from being dispersed in the container proper 2. The portion of the developer having flowed back into the developer supply container 1, which was prevented from being dispersed in the container proper 2, is temporarily held in the temporary storage 2*f* (FIG. 7). Then, it is discharged again from the developer outlet 2*a*, along with the developer having been guided to the adjacencies of the developer outlet 2*a* by the developer conveyance ridges, as the developer supply container 1 is orbitally moved by the rotation of the rotary.

The partitioning wall 2*e* also contributes to the prevention of the problem that as the developer supply container 1 is orbitally moved by the rotation of the rotary, the developer having been guided to the downstream side of the developer outlet 2*a*, in terms of the rotational direction of the developer supply container 1, by the pair of the developer conveyance ridges 2*d*-2 which are the developer conveyance ridges closest to the developer outlet 2*a* among the plurality of developer conveyance ridges 2*d*-2 of the bottom section of the container proper 2 having the developer outlet 2*a*, is dispersed in the developer supply container 1 by the rotation.

With the provision of the above described structural arrangement, even after the amount of the developer in the developer supply container 1 become small, the developing device 215 can be reliably supplied with a proper amount of developer. In other words, the developer supply container 1 is enabled to reliably discharge the developer at a proper rate from the very beginning of its first time usage to the virtual end of its service life.

Also with the provision of the above described structural arrangement, the developer supply container 1 is smaller, in the amount of the developer in a developer supply container 1, which cannot be discharged from the developer supply container 1, and the amount of the developer in the developer supply container, which remains adhered to the internal surface of the developer supply container 1, than a developer supply container in accordance with the prior art. In other words, in the case of the developer supply container 1 in this embodiment, virtually the entirety of the developer in the developer supply container 1 can be discharged.

Further, the developer outlet of the developer supply container 1 in this embodiment is not blocked by the developer in the developer supply container 1 regardless of the environment in which the developer supply container 1 is used.

Further, the partitioning wall 2*e* can be formed as an integral part of the top section 2-1 of the container proper 2, making it possible, without cost increase, to stabilize the rate at which the developer is discharged therefrom, and to reduce the amount of the developer which cannot be discharged therefrom.

In terms of the axial direction of the rotary, the partitioning wall 2*e* is desired to be positioned in the adjacencies of the developer outlet 2*a* through which the developer in the developer supply container 1 falls because of its own weight. If the distance between the partition wall 2*e* and the developer outlet 2*a* in terms of the axial direction of the rotary is greater than a certain value, the partitioning wall 2*e* is not effective because even if it prevents the developer from flowing back from the developing device to the developer supply container, it is smaller in the amount by which it guides the developer having flowed back, to the developer outlet 2*a*. The partitioning wall 2*e* is positioned so that it does not interfere with the developer conveyance by the developer conveyance ridges 2*d*-2 of the bottom section 2-2 of the container proper 2.

Further, the partitioning wall 2*e* is formed roughly perpendicular to the direction in which the developer in the container proper 2 is conveyed to the developer outlet 2*a*. In other words, it is simple in structure. Therefore, the developer having flowed back into the developer supply container 1 from the developing device 215 is at least partially prevented from being dispersed in the container proper 2, and is quickly supplied again to the developing device 215, making it possible to always supply the developing device 215 with a proper amount of the developer from the developer supply container 1, from the beginning of the first time usage of the developer supply container 1 to the virtual end of its service life.

(Experiments)

An experiment was carried out to compare the developer supply container in the first embodiment to a developer supply container which is the same as the developer supply container in the first embodiment except for the lack of the partitioning wall 2*e*. The developer supply container in the first embodiment was 380 mm in length and roughly 470 cc in internal volume.

The developer conveyance ridges 2*d*-1 and 2*d*-2 of the developer supply container 1 shown in FIG. 4 were 5 mm in height. The number of the developer conveyance ridges 2*d*-1 of the top section 2-1 of the container proper 2 was 7 and that of the bottom section 2-2 of the container proper 2 was 8. The amount of the overlap (X in FIG. 5) between a given developer conveyance ridge 2*d*-1 of the top section of the container proper 2, and the developer conveyance ridge 2*d*-2 of the bottom section 2-2 of the container proper 2 located in the direction perpendicular to the lengthwise direction of the container proper 2, was 5 mm. As for the size of the developer outlet 2*a*, it was 15 mm in the axial direction of the container proper 2, and 10 mm in the direction perpendicular to the axial direction of the container proper 2.

The developer supply container 1 in this embodiment and comparative developer supply container were each filled with 180 g of developer, and were tested for developer discharge, using a testing jig, which is a simplified version of a rotary developing apparatus (developing devices were removed from rotary developing apparatus to make it possible to directly measure amount by which developer was discharged from intermediary developer chamber). The number of the testing jigs was three (360°÷120°=3).

(Test Results)

After the virtual depletion of the developer in the developer supply containers resulting from the discharging of the developer therefrom, the amount of the developer which was remaining in the developer supply container 1 having no partitioning wall 2*e* was 11 g, whereas that in the developer supply container 1, in the first embodiment, having the partitioning wall 2*e* was 4.5 g.

Figure 8:
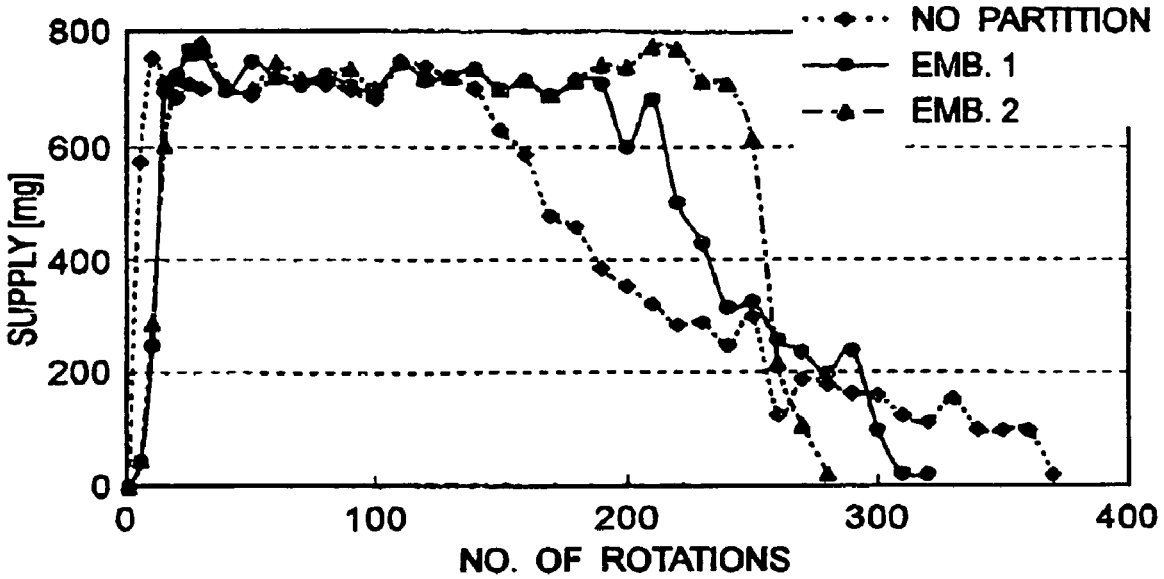
FIG. 8 is a graph showing the relationship between the number of times the rotary of the rotary developing apparatus was rotated and the amount by which developer was supplied to the developing device from the developer supply container having no partitioning wall, the relationship between the number of times the rotary of the rotary developing apparatus was rotated and the amount by which developer was supplied to the developing device from the developer supply container in the first embodiment, and the relationship between the number of times the rotary of the rotary developing apparatus was rotated and the amount by which developer was supplied to the developing device from the developer supply container in the second embodiment.

FIG. 8 is a graph showing the differences among the three types of a developer supply container different in structure. In this experiment, the length of time the developer conveying member 8*a* of the intermediary developer chamber 8 was rotated was set so that the amount by which the developing device was supplied with developer per full rotation of the rotary became roughly 750 g. FIG. 8 suggests that the provision of the partitioning wall 2*a* makes it possible for the developer in the developer supply container to be continuously supplied to the developing device at virtually the same rate as the rate at which the developer was supplied at the very beginning of the first time usage of the developer supply container, even after the amount of the developer remaining in the developer supply container became rather small.

In FIG. 8, the developer supply container with no partitioning wall is represented by the combination of solid black squares and dotted lines, and the developer supply container in the first embodiment of the present invention is represented by the combination of solid black circles and solid lines.

Embodiment 2

Next, referring to FIGS. 9 and 10, the developer supply container in the second embodiment of the present invention will be described. The developer supply container in this embodiment is a modification of the above described developer supply container in the first embodiment; the former is different from the latter in that the latter has an improved version of the partitioning wall 2*e* in the former.

In terms of general structure, an electrophotographic copying machine as an example of an electrophotographic image forming apparatus in which the developer supply container in this embodiment is mounted is virtually the same as that in the first embodiment described above with reference to FIG. 1. Thus, the members of the copying machine in this embodiment, which are the same in function as those in the first embodiment will be given the same referential symbols as those given in the description of the first embodiment, and will not be described here. In other words, only the members of the image forming apparatus different from those in the first embodiment will be described. In terms of shape and external structure, the developer supply container in this embodiment is the same as that in the first embodiment.

(L-shaped Partitioning Wall)

Figure 9:
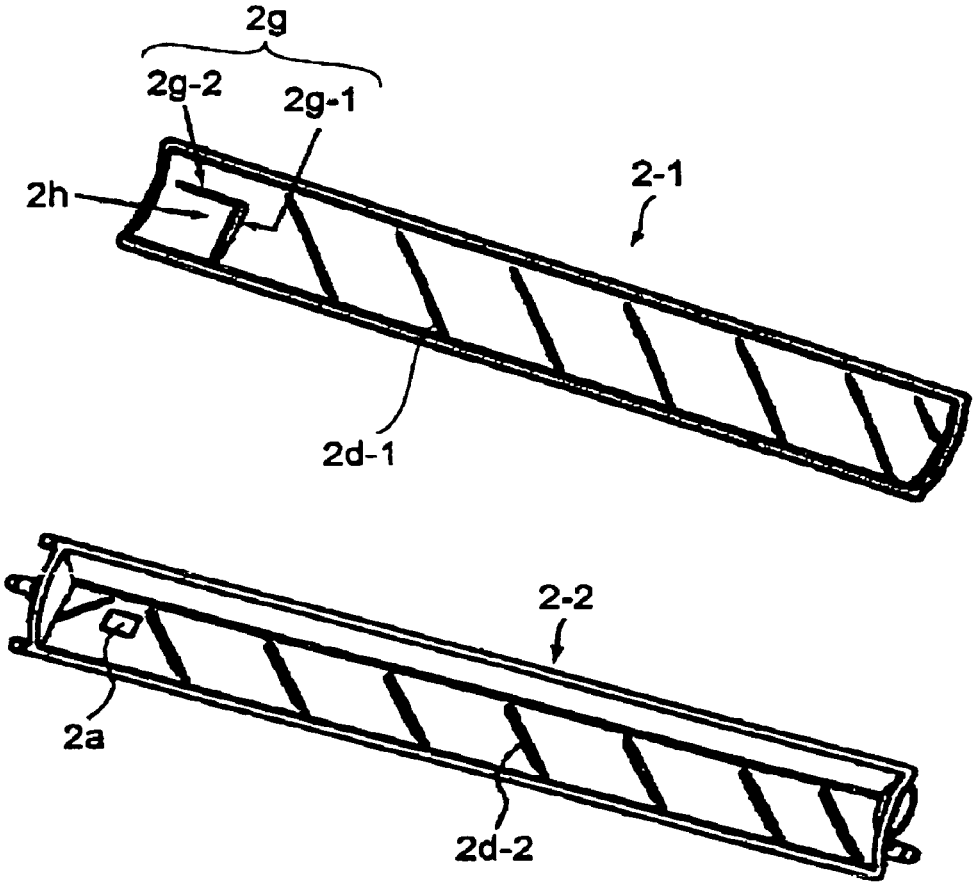
FIG. 9 is a schematic drawing of the top and bottom sections of the developer supply container in the second embodiment, as seen from the direction in which the two sections are to be removed from the metallic molds thereof.

Referring to FIG. 9, the top section 2-1 of the developer supply container 1 in the second embodiment is provided with an L-shaped partitioning wall 2*g*, which is different from the partitioning wall 2*e* in the first embodiment in that it comprises a primary portion 2*g*-1 (development movement controlling portions) similar to the partitioning wall 2*e* in the first embodiment, and a portion 2*g*-2, or a barrier portion, extending from the upstream end of the primary portion 2*g*-1, in terms of the rotational direction of the developer supply container 1, perpendicular to the primary portion 2*g*-1. The partitioning wall 2*g* is an integral part of the developer supply container 1.

In the case of the developer supply container structure in the first embodiment shown in FIG. 7, as the developer flows back from the developing device into the developer supply container because of the rotation of the rotary, it is temporarily held in the temporary storage portion 2*f*, being thereby prevented by the partitioning wall 2*e* from being dispersed in the developer supply container, and then, it is discharged again into the developing device as the rotary is rotated. It is possible, however, that while the developer in the temporary storage portion 2*f* is moved in the rotational direction of the developer supply container by the rotation of the rotary, it is dispersed again in the developer supply container.

In the second embodiment, therefore, the developer supply container 1 is provided with the L-shaped partitioning wall 2*g* in order to deal with the above described problem the developer supply container in the first embodiment has. More specifically, referring to FIG. 10, the partitioning wall 2*g* as a developer movement controlling member in the second embodiment comprises the portion 2*g*-2 as a barrier portion, in addition to the primary portion 2*g*-1 equivalent to the partitioning wall 2*e* in the first embodiment. The barrier portion 2*g*-1 prevents the developer having flowed back into the container proper 2 of the developer supply container 1 through the developer outlet 2*a* while the developer outlet 2*a* is directed upward by the rotation of the rotary, from moving in the rotational direction of the developer supply container 1 along the internal surface of the container proper 2 as the rotary is rotated. The barrier portion 2*g*-2 extends from one end of the primary portion 2*g*-1. It also is an integral part of the top section 2-1 of the developer supply container 1, as is the primary portion 2*g*-1, equivalent to the partitioning wall 2*e* in the first embodiment, of the partitioning wall 2*g*.

Next, referring to FIG. 10, the effect of the L-shaped partitioning wall 2*g* will be described.

Figure 10:
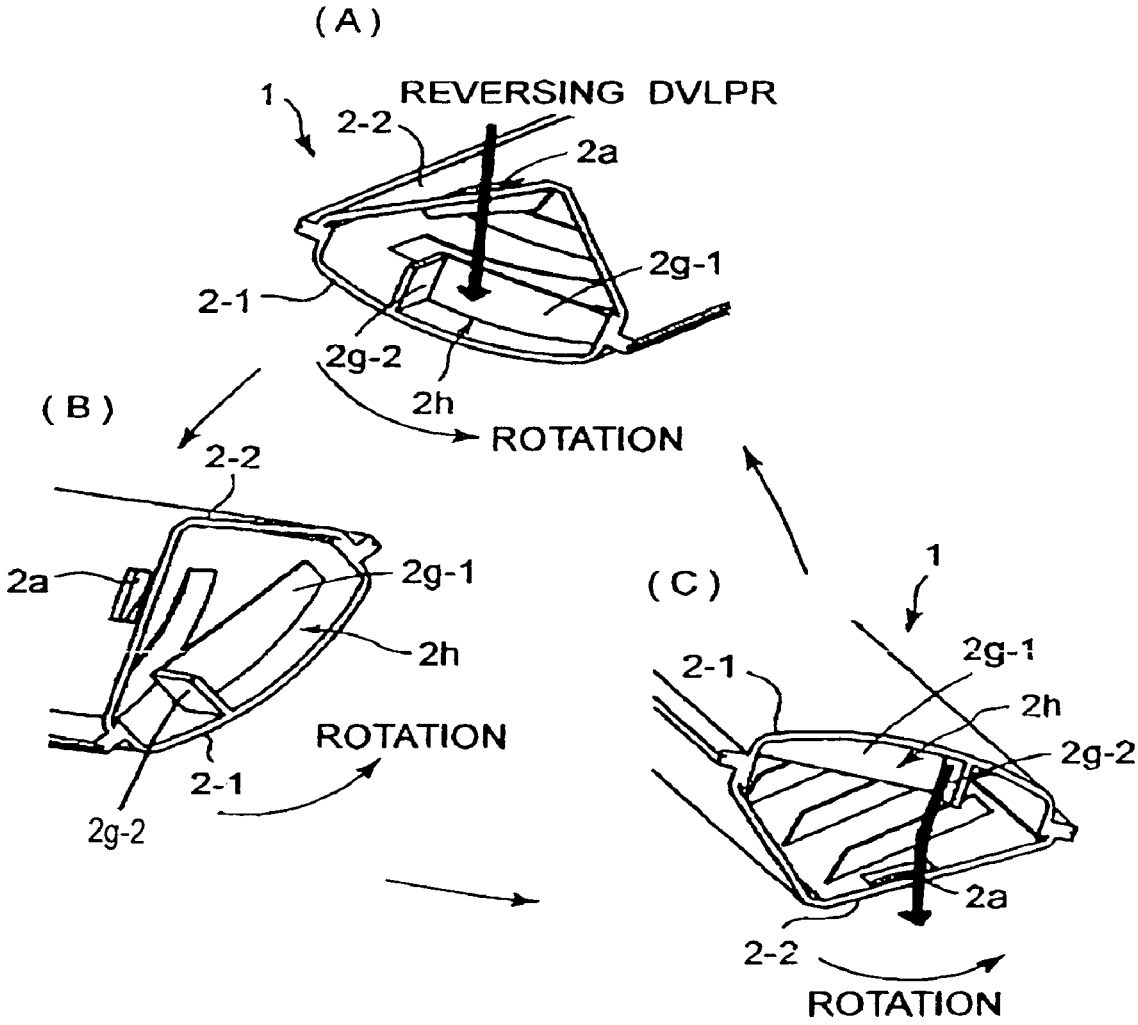
FIG. 10 is a perspective view of one of the lengthwise end portions of the developer supply container in the second embodiment, showing the developer outlet of the container, and the adjacencies of the partitioning wall of the container.

Referring to FIG. 10, as the developer supply container 1 is orbitally moved by the rotation of the rotary, the developer outlet 2*a* faces upward (FIG. 10(A)). As the developer outlet 2*a* faces upward, the developer having fallen into the developer supply container 1 partially flows back into the developer supply container 1, more specifically, the temporary storage portion 2*h* of the developer supply container 1 created by the provision of the partitioning wall 2*g*. The developer having flowed back into the temporary storage portion 2*h* is partially dammed up by the primary portion 2*g*-1 of the partitioning wall 2*g* roughly perpendicular to the rotational axis of the rotary, being thereby prevented from being dispersed in the developer supply container 1. Further, the developer having fallen back into the temporary storage portion 2*f* is prevented by the barrier portion 2*g*-2 roughly perpendicular to the primary portion 2*g*-1, from being dispersed again in the developer supply container 1 of the partitioning wall 2*g*, while it is moved in the rotational direction of the developer supply container 1 by the rotation of the developer supply container 1.

With the provision of the above described structural arrangement, the movement of the developer caused by the rotation of the developer supply container is partially blocked. Therefore, the developer having flowed back from the developing device, and the developer having been guided to the downstream side of the developer outlet 2*a*, in terms of the rotational direction of the developer supply container, by the pair of developer conveyance ridges 2*d*-2 closest to the developer outlet 2*a*, can be made to more efficiently converge to the temporary developer storage portion 2*h*.

As the developer supply container 1 is moved by the rotation of the rotary into the range in which the developer outlet 2*a* of the developer supply container 1 faces downward (FIG. 10(C)), the developer having remained in the temporary storage portion 2*h* slides on the barrier portion 2*g*-2, straight to the developer outlet 2*a*, and free falls into the developing device through the developer outlet 2*a*.

In other words, with the provision of the above described structural arrangement, the developer having arrived at the developer outlet 2*a* is not immediately discharged through the developer outlet 2*a*. It is temporarily dammed up by the barrier portion 2*g*-2, and then, is allowed to fall to the developer outlet 2*a*. Therefore, by the time the developer is discharged through the developer outlet 2*a*, it is fluffed up with air, becoming more fluid and very low in bulk density. Therefore, it does not block the passage between the developer supply container and developing device; it is smoothly discharged into the developing device through the developer outlet 2*a*. Further, it more easily mixes with the developer in the developing device as it is discharged into the developing device. Further, when the developer in the developer supply container 1 is two-component developer, there will be an additional benefit that the toner in the two-component developer is very quickly and uniformly charged, because the toner in the two-component developer more easily mixes with the carrier in the developing device, as the two-component developer in the developer supply container 1 is supplied to the developing device.

Also with the provision of the above described structural arrangement, the develop supply container 1 can continuously provide the developing device 215 with the developer at a preset rate even after the amount of the developer remaining in the developer supply container 1 becomes substantially small. In other words, the amount by which the developer is discharged from the developer supply container 1 per full rotation of the rotary can be kept constant from the very beginning of the first time usage of the developer supply container 1 to the virtual end of its service life.

Further, the developer supply container 1 in this embodiment is smaller, in the amount of the developer which cannot be discharged therefrom, and the amount of the developer which remains adhered to the internal surface of the developer supply container 1, than a developer supply container in accordance with the prior art. In other words, in the case of the developer supply container 1 in this embodiment, virtually the entirety of the developer in the developer supply container 1 can be discharged.

Further, the problem that the developer outlet of a developer supply container is plugged up with the developer in the developer supply container does not occur regardless of the environment in which the developer supply container is used.

Further, the L-shaped partitioning wall 2*g* in this embodiment is integrally formed with the top section 2-1 of the container proper of the developer supply container 1, stabilizing, without cost increase, the rate at which developer is discharged from the developer supply container 1, and reducing the ratio of the developer in the developer supply container 1 which cannot be discharged.

Although the developer supply container 1 in this embodiment is provided with only a single partitioning wall 2*g*, which is located near one of the lengthwise end of the developer supply container 1, the present invention does not limit the number of the partitioning member 2*g* to one. For example, if a developer supply container is structured so that its developer outlet 2*a* is located a substantial distance away from the lengthwise ends of the developer supply container, and the developer in the developer supply container is conveyed to the developer outlet 2*a* from two directions in terms of the lengthwise direction of the developer supply container, the developer supply container may be provided with two partitioning walls 2*g*. In such a case, the partitioning walls 2 will be U-shaped.

(Experiment and Results)

The experiment similar to the experiment which was carried out to test the developer supply container 1 in the first embodiment was carried out to test the developer supply container 1 in this embodiment. In the case of the developer supply container 1 in this embodiment, the amount of the developer in the developer supply container 1 which could not discharged was 2.8 g, proving the superiority of this embodiment. Also in the case of the developer supply container 1 in this embodiment, the amount by which the developer was discharged per full rotation of the rotary remained constant throughout the service life of the developer supply container 1, even after the amount of the developer remaining in the developer supply container 1 became small. FIG. 8 suggests that the provision of the L-shaped partitioning wall 2*g* made it possible to discharge the developer from the developer supply container 1 virtually at a stable rate throughout the service life of the developer supply container 1 even after the amount of the developer remaining in the developer supply container 1 became small.

In FIG. 8, the developer supply container in the second embodiment having the partitioning wall 2*g* is represented by the combination of solid black triangles and double-dot chain lines. The developer supply container with no partitioning wall, and the developer supply container in the first embodiment of the present invention, are represented by the combination of solid black squares and dotted lines, acid the combination of solid black circles and solid lines, respectively.

(Miscellaneous Embodiments)

In the above described embodiments, the number of the developing devices held in the rotary was three. However, the number of the developing devices to be held in the rotary does not need to be limited to three. It is optional, and may be changed as necessary.

Also in the above described embodiments, the image forming apparatus was a copying machine. However, the application of the present invention is not to be limited to a copying machine. In other words, the present invention is also applicable to image forming apparatuses other than a copying machine, for example, a printer, a facsimile machine, etc. Further, in the preceding embodiments, the image forming apparatus employed the transfer belt, as an intermediary transferring member. However, the present invention is also applicable to an image forming apparatus which employs a transfer drum, on which toner images different in color are sequentially transferred in layers, and from which the transferred toner images are transferred all at once onto transfer medium, or an image forming apparatus employing a transfer medium conveyance member such as a transfer medium conveyance drum, or the like, which carries transfer medium onto which toner images different in color are sequentially transferred in layers from the photosensitive drum. The effects which can be obtained by applying the present invention to the developer supply containers used by these image forming apparatuses are the same as those obtained by the developer supply container in the preceding embodiments.

While the invention has been described with reference to the structures disclosed herein, it is not confined to the details set forth, and this application is intended to cover such modifications or changes as may come within the purposes of the improvements or the scope of the following claims.

As described above, according to each of the preceding embodiments of the present invention described above, the amount by which the developer in a developer supply container is discharged from the developer supply container per full rotation of the rotary can be kept constant from the very beginning of the first time usage of the developer supply container to virtually the very end of its service life, even after the amount of the developer in the developer supply container became small.

Further, a developer supply container can be reduced in the amount of the developer in a developer supply container which cannot be discharged, and also, in the amount of the developer in a developer supply container which remains adhered to the internal surface of the developer supply container. In other words, the virtually the entirety of the developer in the developer supply container can be discharged.

Further, the phenomenon that the developer outlet of a developer supply container is blocked by the developer in the developer supply container, can be prevented regardless of the environment in which the developer supply container is used.

What is claimed is:

1. A developer supply container substantially non-rotatably mountable, with a developing device for developing an electrostatic image with a developer, to a rotatable member provided in an image forming apparatus, said developer supply container being adapted to supply a developer into the developing device therefrom with rotation of the rotatable member, said developer supply container comprising:

a container body for containing the developer;

a discharging opening, formed in a peripheral surface of said container body, for permitting downward discharge of the developer;

a feeding portion, provided on an inside surface of said container body, for feeding the developer in a feeding direction toward said discharge opening with rotation of said rotatable member; and a developer movement constraining portion, provided adjacent a position opposed to a position of said discharge opening on the inside surface of said container body, independently of said feeding portion, for constraining the developer which is reversed into said container body through said discharge opening when said discharge opening faces upward with rotation of said rotatable member, from moving in a direction opposite to the feeding direction.

2. A developer supply container according to claim 1, wherein said developer movement constraining portion includes a projected portion which is projected from the inside surface of said container body, said projected portion extending in a direction substantially perpendicular to the feeding direction.

3. A developer supply container according to claim 1 or 2, further comprising a developer rotational movement constraining portion for constraining movement of the reversed developer from making a rotational movement along the inside surface of said container body with rotation of the developer.

4. A developer supply container according to claim 3, wherein said developer rotation movement constraining portion includes a projected portion which is projected from the inside surface of said container body, said projected portion extending in a direction substantially perpendicular to the rotational movement of the developer.

5. A developer supply container according to claim 4, wherein said developer constraining portion and said developer rotational movement constraining portion are integral with each other.

6. A developer supply container according to claim 1, wherein said feeding portion is provided with a guiding portion for guiding a part of the developer fed toward said discharge opening to a position downstream of said discharge opening with respect to the feeding direction.

* * * * *

UNITED STATES PATENT AND TRADEMARK OFFICE

CERTIFICATE OF CORRECTION

PATENT NO. : 7,054,581 B2
APPLICATION NO. : 10/796073
DATED : May 30, 2006
INVENTOR(S) : Junko Yoshikawa et al.

It is certified that error appears in the above-identified patent and that said Letters Patent is hereby corrected as shown below:

COLUMN 3
Line 18, “are” should read --is--.

COLUMN 4
Line 40, “synchronizes” should read --synchronized--.

COLUMN 7
Line 67, “tiled” should read --tilted--.

COLUMN 8
Line 3, “or” should read --of--; and
Line 14, “ciency” should read --ciently--.

COLUMN 9
Line 46, “container i,” should read --container 1,--.

COLUMN 10
Line 1, “give” should read --given--.

COLUNN 11
Line 61, “claw” should read --claws--.

COLUMN 12
Line 18, “knob 5 is transmitted by the above described gear of the” should be deleted; and
Line 56, “votary” should read --rotary--.

COLUMN 15
Line 3, “become” should read --becomes--.

COLUMN 19
Line 40, “not discharged” should read --not be discharged--; and
Line 61, “acid” should read --and--.

COLUMN 20
Line 47, “the” (first occurrence) should be deleted.

UNITED STATES PATENT AND TRADEMARK OFFICE

CERTIFICATE OF CORRECTION

PATENT NO. : 7,054,581 B2
APPLICATION NO. : 10/796073
DATED : May 30, 2006
INVENTOR(S) : Junko Yoshikawa et al.

It is certified that error appears in the above-identified patent and that said Letters Patent is hereby corrected as shown below:

COLUMN 22

Line 6, "rotation" should read --rotational--.

Signed and Sealed this

Ninth Day of January, 2007

JON W. DUDAS
*Director of the United States Patent and Trademark Office*